US011840092B2

(12) United States Patent
Watanabe et al.

(10) Patent No.: US 11,840,092 B2
(45) Date of Patent: Dec. 12, 2023

(54) LIQUID EJECTION HEAD

(71) Applicant: CANON KABUSHIKI KAISHA, Tokyo (JP)

(72) Inventors: Makoto Watanabe, Kanagawa (JP); Junichiro Iri, Kanagawa (JP); Naruyuki Nojo, Kanagawa (JP); Motoaki Sato, Tokyo (JP); Yusuke Hashimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 17/518,474

(22) Filed: Nov. 3, 2021

(65) Prior Publication Data

US 2022/0143982 A1 May 12, 2022

(30) Foreign Application Priority Data

Nov. 9, 2020 (JP) ..... 2020-186561

(51) Int. Cl.
*B41J 2/175* (2006.01)
*B41J 2/16* (2006.01)

(52) U.S. Cl.
CPC ..... *B41J 2/17526* (2013.01); *B41J 2/1626* (2013.01)

(58) Field of Classification Search
CPC .. B41J 2/17526; B41J 2/1626; B41J 2/14145; B41J 2/1603; B41J 2/1629; B41J 2/1631; B41J 2/1632; B41J 2/1634; B41J 2/17553; B41J 2/1753
See application file for complete search history.

(56) References Cited

U.S. PATENT DOCUMENTS

2016/0279936 A1* 9/2016 Yamamoto ..... B41J 2/14145

FOREIGN PATENT DOCUMENTS

JP 2007269016 A 10/2007

OTHER PUBLICATIONS

IP.com search (Year: 2023).*

* cited by examiner

*Primary Examiner* — Lisa Solomon
(74) *Attorney, Agent, or Firm* — Canon U.S.A., Inc. IP Division

(57) ABSTRACT

A liquid ejection head includes an ejection-port formed member including liquid ejection ports, a substrate including liquid supply ports for supplying liquid to the ejection ports and a partition between the liquid supply ports, and a substrate supporting member. The liquid supply ports extend along the longitudinal direction of the substrate when viewed from a position facing the main surface of the substrate. The liquid supply ports are arrayed along the lateral direction of the substrate when viewed from the position facing the main surface. The partition includes a non-contact portion that is not in contact with the supporting member and a contact portion that is in contact with the supporting member. Of the liquid supply ports, adjacent liquid supply ports communicate with each other in the lateral direction through a gap between the non-contact portion and the supporting member, and liquid flows through the gap.

7 Claims, 9 Drawing Sheets

LIQUID EJECTION HEAD

BACKGROUND

Field of the Disclosure

The present disclosure relates to liquid ejection heads.

Description of the Related Art

Examples of liquid ejection apparatuses (printing apparatuses) that eject liquid to printing media include an ink-jet printer. The ink-jet printer includes a liquid ejection head, which is a portion that ejects liquid (ink). The liquid ejection head typically includes a printing element substrate including an ejection-port formed member having a plurality of ejection ports for ejecting liquid and a substrate having liquid supply ports for supplying liquid to the ejection ports.

Japanese Patent Laid-Open No. 2007-269016 discloses a printing element substrate in which multiple liquid supply ports are separately independently formed in a substrate, as shown in FIGS. 8A and 8B. FIG. 8A is a plan view of the substrate 1 viewed from a position facing a main surface 20 of the substrate 1. FIG. 8B is a cross-sectional view taken along line VIIIB-VIIIB in FIG. 8A. Liquid (ink) is supplied to ejection ports 5 from ink tanks that contain the liquid through liquid supply ports 7.

Depending on the recording pattern (printing pattern), a large amount of liquid may be ejected from a specific ejection port. In this case, with a configuration in which multiple liquid supply ports are independently formed, as shown in FIGS. 8A and 8B, more liquid is consumed through a liquid supply port communicating with the specific ejection port. This causes the liquid in an ink tank connected to the liquid supply port to be used up earlier than the ink in the other ink tanks. This may require replacing the liquid ejection head with a new one despite the fact that the other ink tanks are sufficiently filled with liquid.

Conceivable configurations include a configuration for communicating among multiple liquid supply ports 7, as shown in FIGS. 9A and 9B. FIG. 9A is a plan view corresponding to FIG. 8A. FIG. 9B is a cross-sectional view taken along line IXB-IXB of FIG. 9A. As shown in FIG. 9B, the multiple liquid supply ports 7 communicate with one another. The liquid supply ports communicate along the lateral direction of the substrate 1 (in the X-direction). Even if liquid is consumed through a specific ejection port, the communication among the multiple liquid supply ports 7 allows liquid to be supplied through the other liquid supply ports 7. This allows for preventing heavy consumption of liquid through only the specific ink tank. However, the configuration shown in FIGS. 9A and 9B in which partitions 19 between the liquid supply ports 7 are removed by etching or the like to communicate among the multiple liquid supply ports 7 can result in a decrease in the strength of the substrate 1. Furthermore, the configuration has portions where the substrate 1 is not joined to the supporting member 18 that supports a printing element substrate 15. This decreases the rigidity of the substrate 1, which may cause a crack 12 in the printing element substrate 15 when an external stress is applied.

SUMMARY

Accordingly, aspects of the present disclosure provide a liquid ejection head with sufficient strength of the substrate while preventing biased consumption of liquid among liquid supply ports.

A liquid ejection head according to an aspect of the present disclosure includes an ejection-port formed member including ejection ports that eject liquid, a substrate including a plurality of liquid supply ports for supplying liquid to the ejection ports of the ejection-port formed member and a partition between the plurality of liquid supply ports, and a supporting member that supports the substrate. The liquid supply ports extend in a longitudinal direction of the substrate when viewed from a position facing a main surface of the substrate. The plurality of liquid supply ports are arrayed along a lateral direction of the substrate when viewed from the position facing the main surface of the substrate. The partition includes a non-contact portion that is not in contact with the supporting member and a contact portion that is in contact with the supporting member. Of the plurality of liquid supply ports, adjacent liquid supply ports communicate with each other in the lateral direction between the non-contact portion and the supporting member when viewed from the position facing the main surface of the substrate.

Further features of the present invention will become apparent from the following description of exemplary embodiments with reference to the attached drawings.

DESCRIPTION OF THE EMBODIMENTS

First Embodiment

Figure 1:
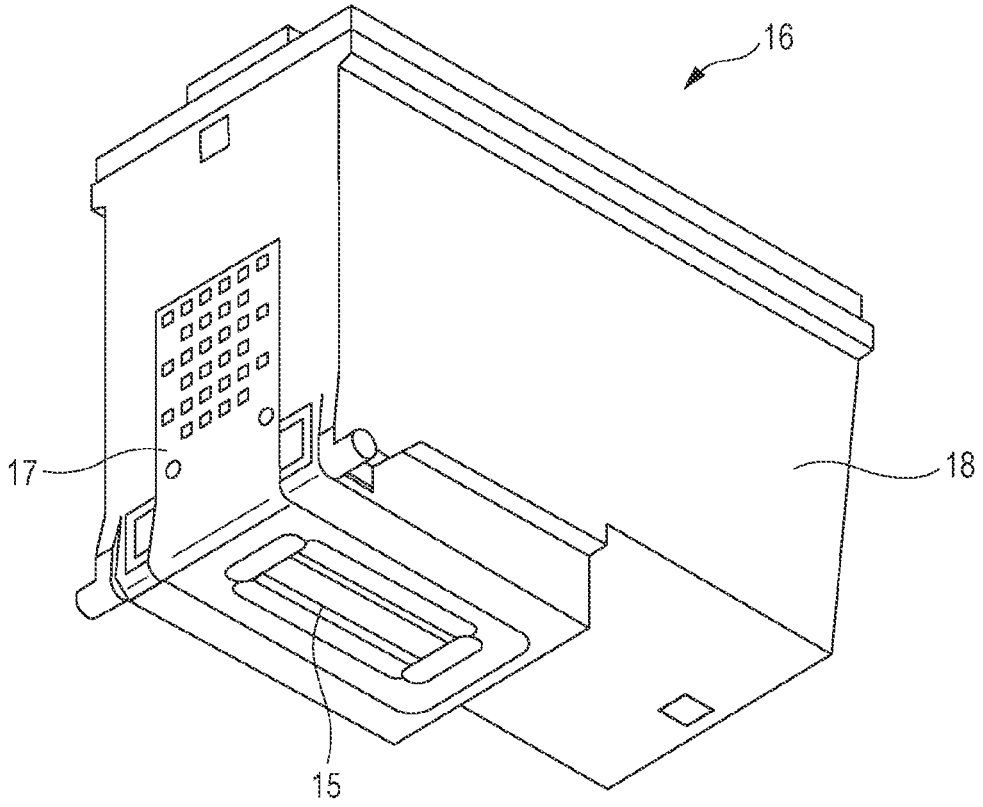
FIG. 1 is a perspective view of a liquid ejection head according to an embodiment of the present disclosure.

A first embodiment will be described with reference to FIG. 1 to FIG. 5D. FIG. 1 is a perspective view of a liquid ejection head 16 according to this embodiment. As shown in FIG. 1, the liquid ejection head 16 mainly includes a printing element substrate 15 having ejection ports 5 that eject liquid (FIG. 2), a flexible printed circuit board 17, and a casing 18 that contains ink to be supplied to the ejection ports 5. The flexible printed circuit board 17 includes wiring lines for supplying electric power to the printing element substrate 15. Since the casing 18 serves also as a member for supporting the printing element substrate 15, it is sometimes expressed as "supporting member".

Figure 2:
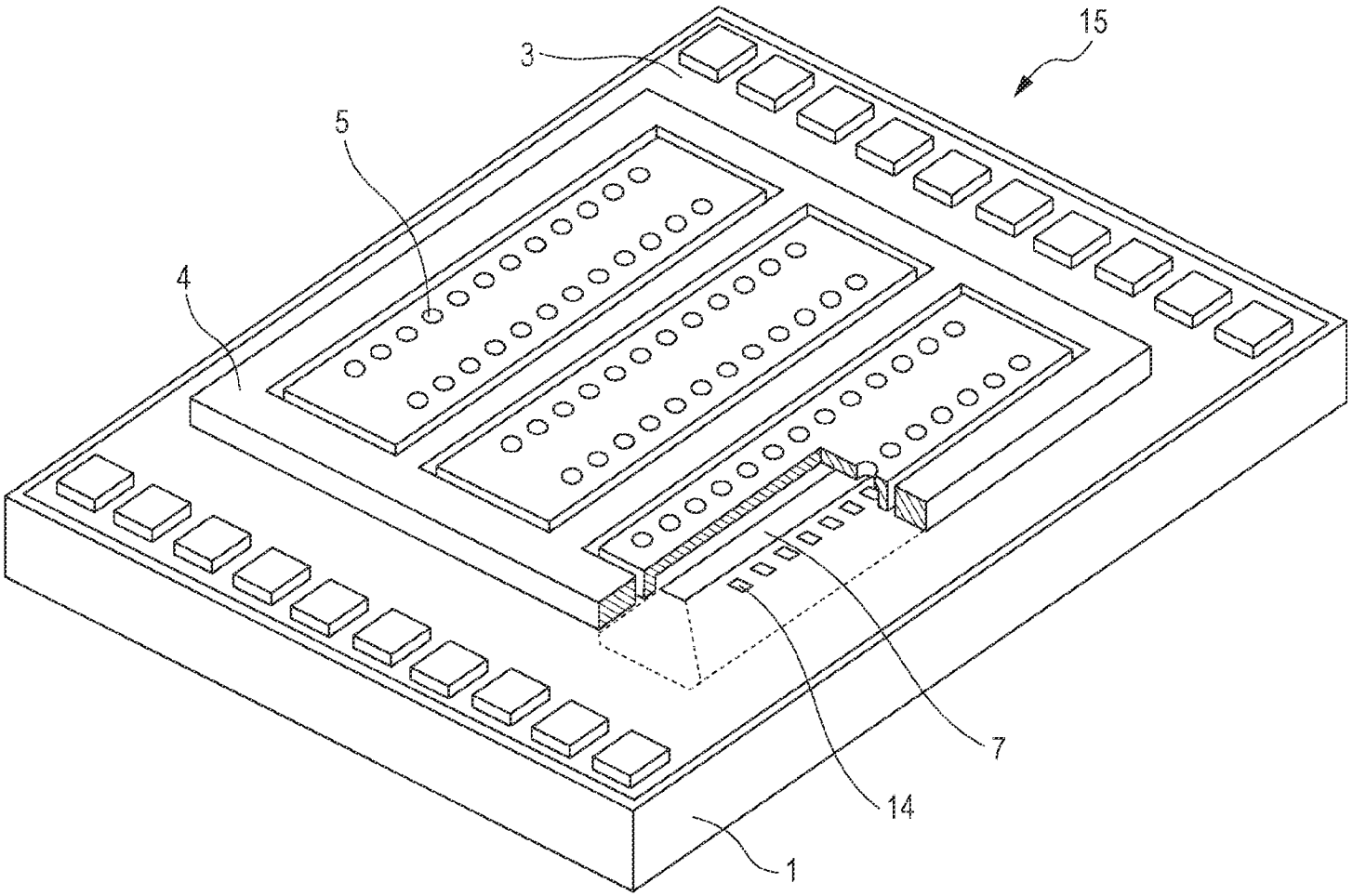
FIG. 2 is a perspective view of a printing element substrate according to an embodiment of the present disclosure.

FIG. 2 is a perspective view of the printing element substrate 15. The printing element substrate 15 has energy generating elements 14, formed at predetermined pitches, for generating energy for ejecting liquid through the ejection ports 5. The substrate 1 also has multiple liquid supply ports 7 for supplying liquid from the casing 18 to the ejection ports 5. The substrate 1 is made of silicon, for example. The substrate 1 may be a monocrystal silicon substrate. The ejection ports 5, which correspond to the individual energy generating elements 14, are provided in an ejection-port formed member 4 on the substrate 1. The ejection-port formed member 4 may have high mechanical strength as a structural material, adhesion with the base, ink resistance, and resolution for patterning a fine pattern for the ejection ports 5. Examples of a material that satisfies those characteristics include a cationic polymerization epoxy resin composition. Examples of the epoxy resin include a reactant of bisphenol A and epichlorohydrin and a reactant of bromo-containing bisphenol A and epichlorohydrin. Another example is a reactant of phenol novolak or O-cresol novolak and epichlorohydrin. The epoxy resin preferably has an epoxy equivalent of 2,000 or less, and more preferably has an epoxy equivalent of 1,000 or less.

Examples of a photo-cationic polymerization initiator for curing epoxy resin include a compound that generates acid when irradiated with light. Examples include aromatic sulfonium salt and aromatic iodonium salt. A wavelength sensitizer may be added as necessary. An example of the wavelength sensitizer is SP-100 which is commercially available from ADEKA Corporation.

The ejection-port formed member 4 may be made of not only such resins but also an inorganic film, such as a silicon substrate, a metal layer, or silicon nitride.

Figure 3A:
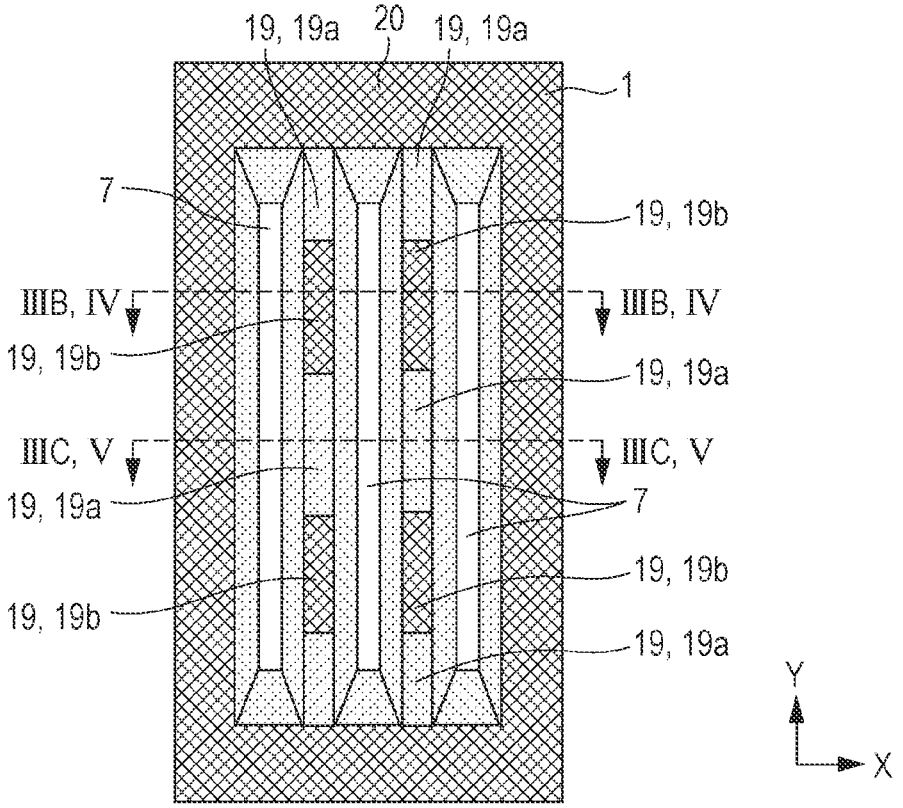
FIGS. 3A to 3C are schematic diagrams of a printing element substrate according to a first embodiment of the present disclosure.
Figure 3B:
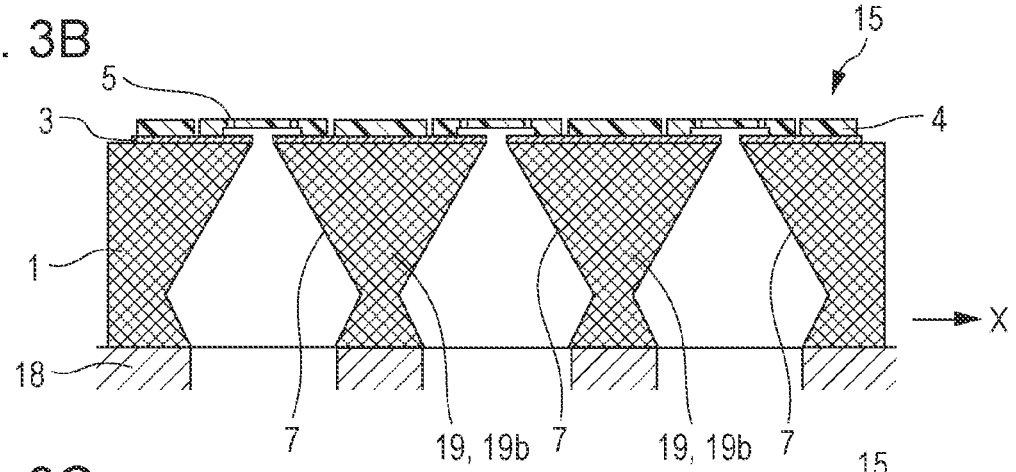
Figure 3C:
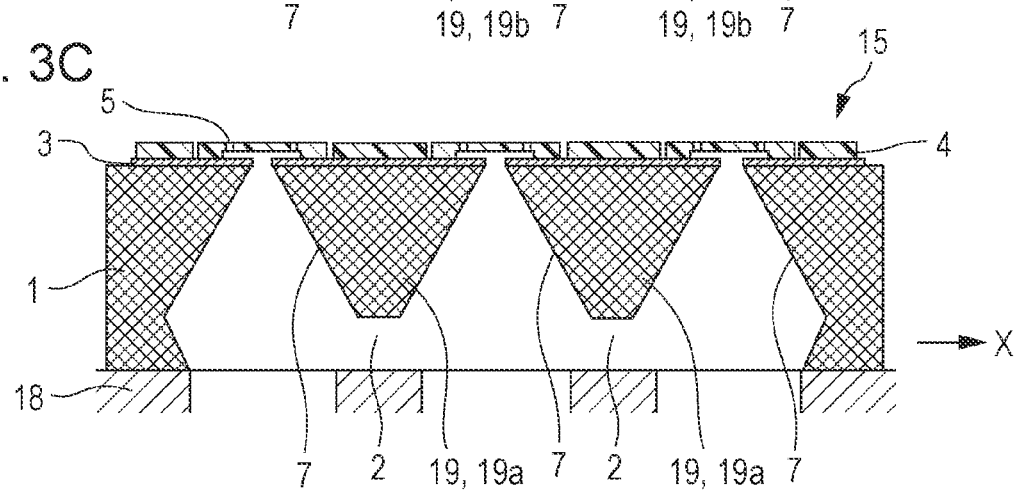

FIG. 3A is a plan view of the printing element substrate 15 viewed from the substrate 1. FIG. 3B is a cross-sectional view taken along line IIIB-IIIB of FIG. 3A. FIG. 3C is a cross-sectional view taken along line IIIC-IIIC of FIG. 3A. As shown in FIG. 3A, the multiple liquid supply ports 7 are arrayed along the lateral direction of the substrate 1 (in the X-direction). Partitions 19 are provided between the liquid supply ports 7. The partitions 19 are part of the substrate 1. In the cross-sectional view shown in FIG. 3B, the liquid supply ports 7 do not communicate with one another in the lateral direction of the substrate 1 (in the X-direction) because of the presence of the partitions 19. In contrast, in the cross-sectional view shown in FIG. 3C, the liquid supply ports 7 communicate with one another in the lateral direction of the substrate 1 because part of the partitions 19 is removed. In other words, the liquid supply ports 7 extend in the longitudinal direction of the substrate 1 (in the Y-direction) viewed from a position facing the main surface 20 of the substrate 1, and each partition 19 includes a non-contact portion 19*a* that is not in contact with the supporting member 18 and a contact portion 19*b* that is in contact with the supporting member 18.

A gap 2 is formed between the non-contact portion 19*a* of the partition 19 and the supporting member 18. The gap 2 allows liquid to flow therethrough. Therefore, even if a large amount of liquid is ejected from the ejection port 5 communicating with the liquid supply port 7 at the left end in FIGS. 3A to 3C, the liquid in the liquid supply port 7 at the center or the right end flows into the liquid supply port 7 at the left end. Thus, even if a large amount of liquid is consumed through a specific ejection port 5, liquid is supplied from the other liquid supply ports 5, thereby preventing early difficulty in supply of liquid to only the specific ejection port 5. Furthermore, the partition 19 includes the contact portion 19*b* that is in contact with the supporting member 18, and the supporting member 18 and the substrate 1 are bonded together with an adhesive at the contact portion 19*b*. This increases the strength of the substrate 1. This prevents deformation of the printing element substrate 15. Furthermore, forming the contact portion 19*b* allows leaving more of the substrate 1, which allows the substrate 1 to have sufficient rigidity.

Figure 4A:
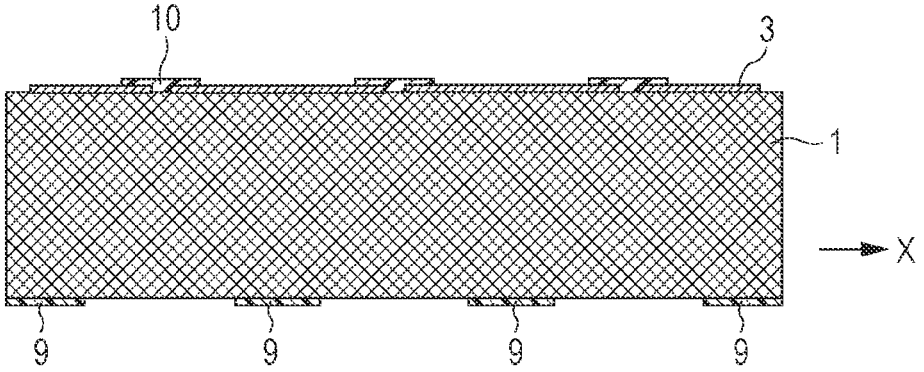
FIGS. 4A to 4D are schematic diagrams illustrating the processes of a method for manufacturing the printing element substrate.

A method for manufacturing the printing element substrate 15 of this embodiment will be described with reference to FIGS. 4A to 4D and FIGS. 5A to 5D. FIGS. 4A to 4D are cross-sectional views taken along line IV in FIG. 3A, illustrating the processes of the method for manufacturing the printing element substrate 15. Likewise, FIGS. 5A to 5D are cross-sectional views taken along line V in FIG. 3A, illustrating the processes of the method for manufacturing the printing element substrate 15. First, the substrate 1, which is a monocrystal silicon substrate having an adhesion improving layer 3 and a channel formed member 10 formed on the front surface and a polyether amide resin serving as a mask layer 9 formed on the back surface, is prepared, as shown in FIG. 4A. In this case, the dimensions of the openings of the liquid supply ports 7 in the mask layer 9 are set to 750 μm in the lateral direction (X-direction) of the substrate 1 and 9,000 μm in the longitudinal direction (Y-direction). The dimension of the non-contact portion in the longitudinal direction is set to 400 μm, and the dimension of the contact portion in the longitudinal direction is set to 600 μm. The non-contact portions that communicate between adjacent liquid supply ports 7 in the lateral direction are not provided with the mask layer 9, as shown in FIG. 5A.

Figure 4B:
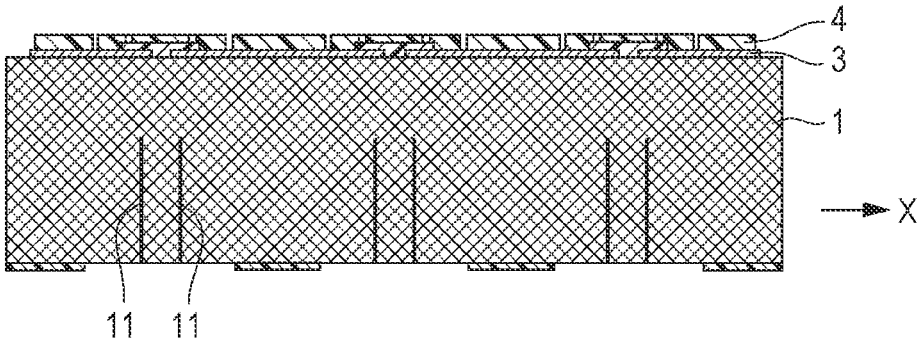
Figure 5A:
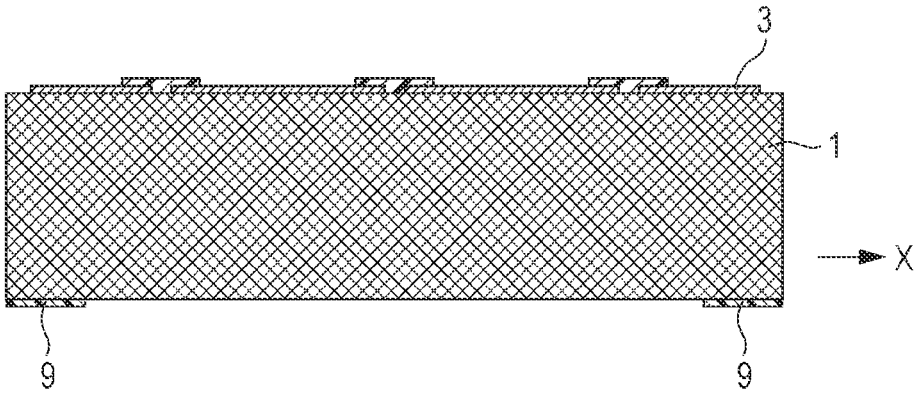
FIGS. 5A to 5D are schematic diagrams illustrating the processes of the method for manufacturing the printing element substrate.
Figure 5B:
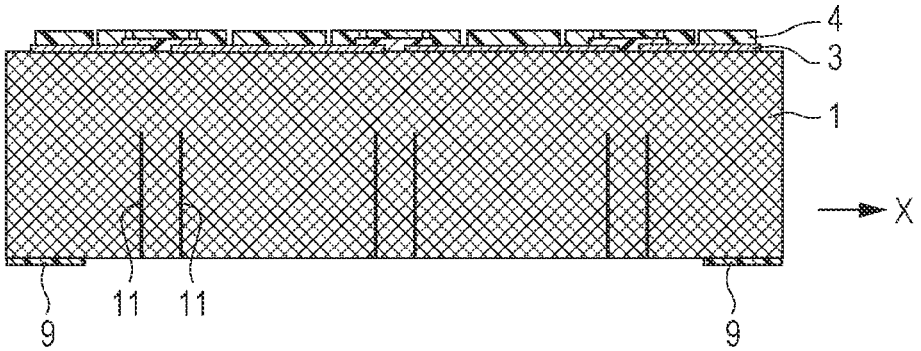

Next, the ejection-port formed member 4 made of cationic polymerized epoxy resin is formed on the channel formed member 10, as shown in FIG. 4B and FIG. 5B. Thereafter, blind holes 11 are formed in the substrate 1 using a laser beam with the third harmonic generation wavelength of YAG laser (THG: 355 nm) to form the liquid supply ports 7.

Figure 4C:
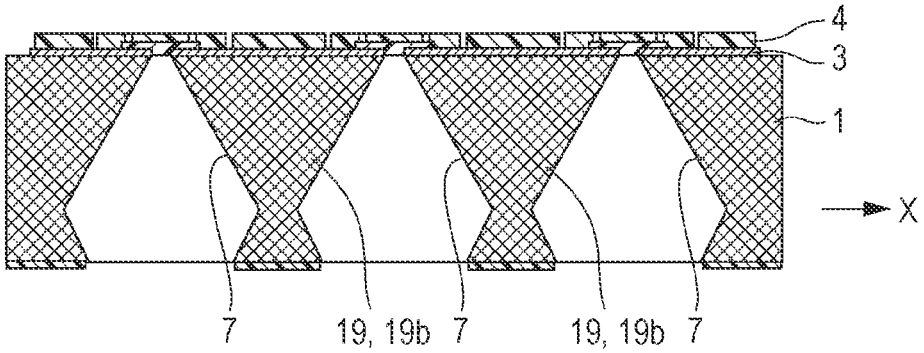
Figure 5C:
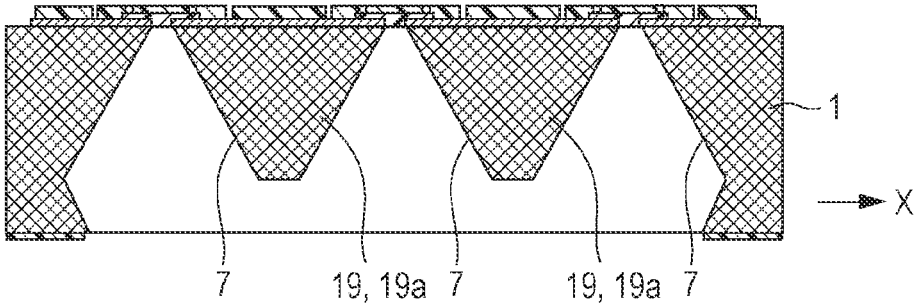

Next, the substrate 1 is anisotropically etched from the back, as shown in FIG. 4C and FIG. 5C. The substrate 1 is anisotropically etched using tetramethylammonium hydroxide (TMAH) as etchant at a liquid temperature of 80° C. for 8.5 hours. Thus, the liquid supply ports 7 that do not communicate with one another in the lateral direction because of the presence of the partitions are formed. The etchant enters the multiple blind holes 11 formed at the back of the substrate 1 to perform etching, so that the openings at which the etching mask layer 9 is not provided and part of the partitions 19 between the adjacent liquid supply ports 7 are etched. As the surface of the substrate 1 is being etched, the interior of the liquid supply ports 7 expands in the lateral direction to form desired openings. Thus, depending on whether a mask layer is formed, the non-contact portion 19*a* that communicates between adjacent liquid supply ports 7 in the lateral direction (X-direction) and the contact portion 19*b* that do not communicate are formed at the partition 19.

Figure 4D:
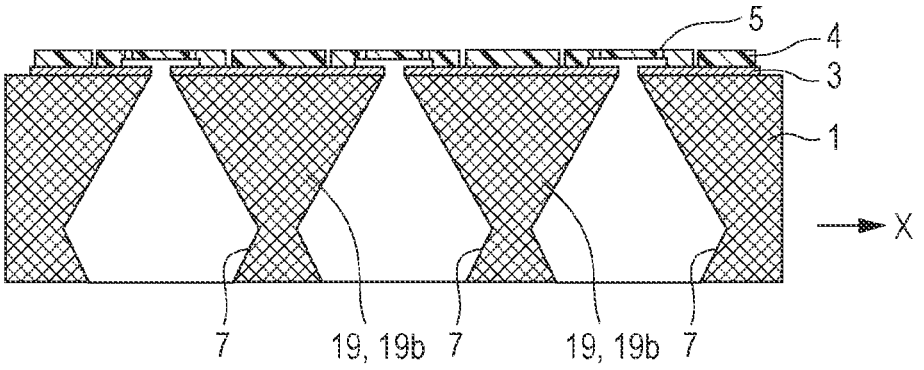
Figure 5D:
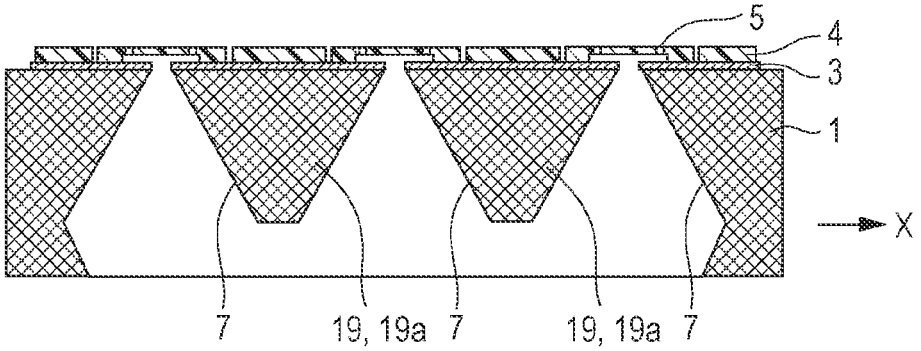

Next, the mask layer 9 on the back of the substrate 1 and the channel formed member 10 on the front surface of the substrate 1 are removed, as shown in FIG. 4D and FIG. 5D. Lastly, the substrate 1 is separated by dicing or the like to form the printing element substrate 15, and the electrical wiring lines are connected, and the printing element substrate 15 is joined to the supporting member 18 to complete the liquid ejection head 16.

Figure 6A:
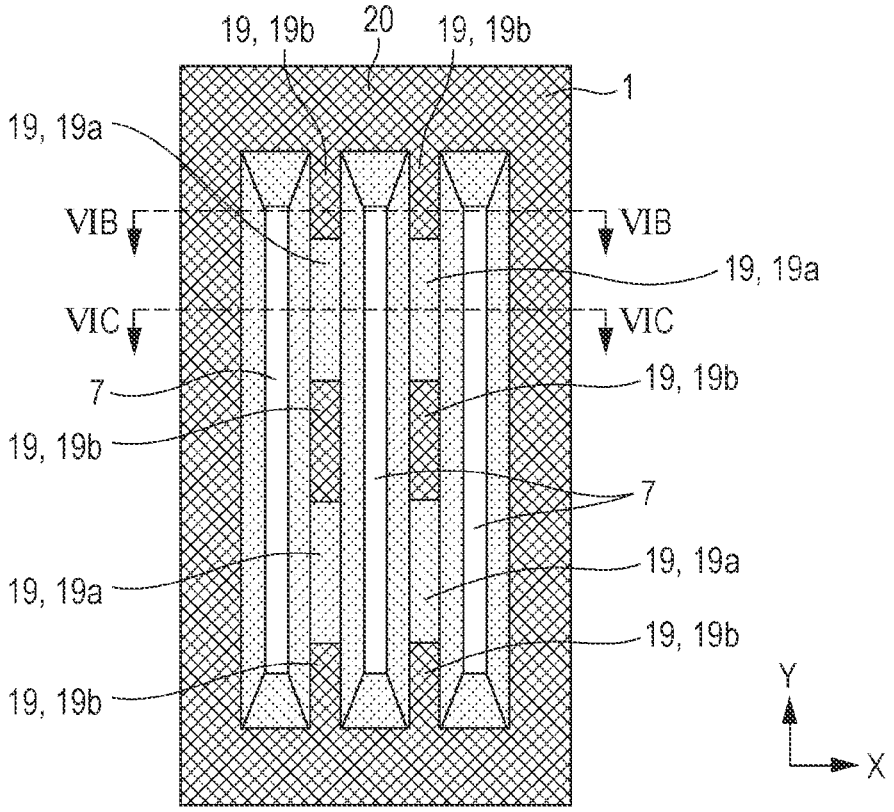
FIGS. 6A to 6C are schematic diagrams of a modification of the printing element substrate.
Figure 6B:
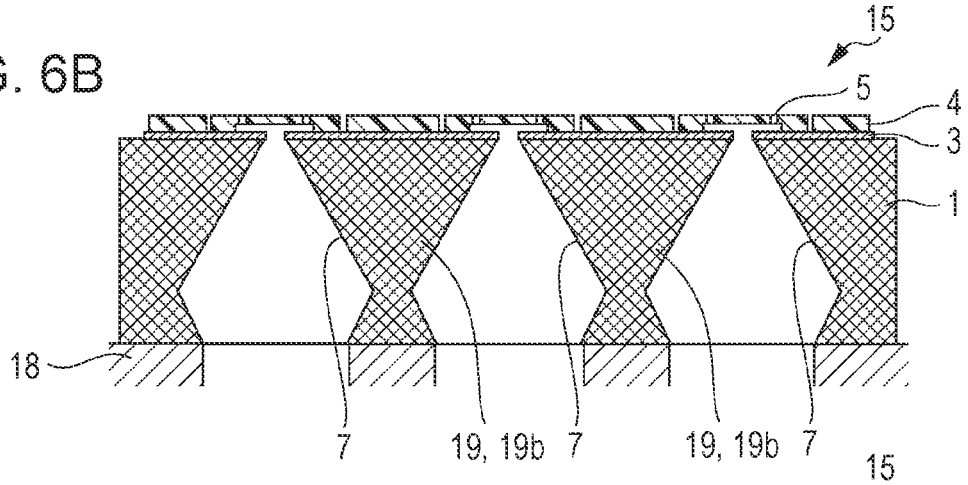
Figure 6C:
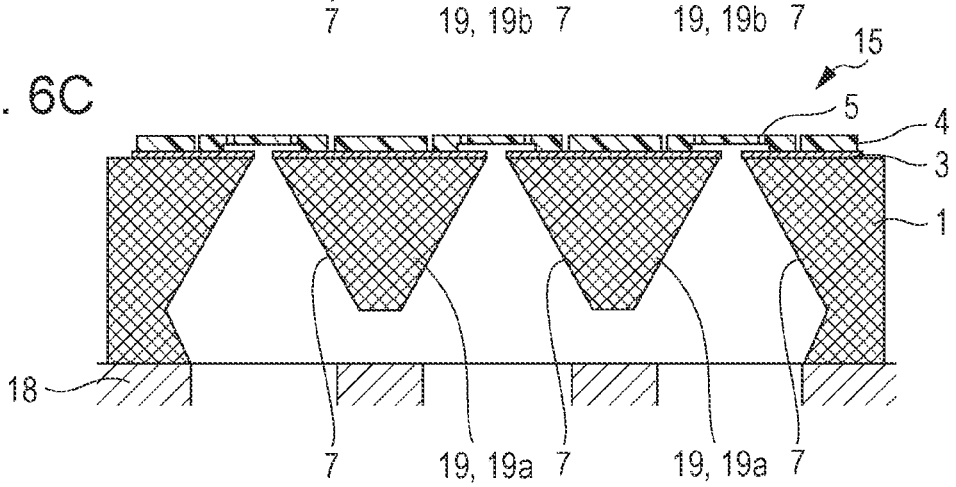

The printing element substrate 15 of this embodiment need not have the configuration shown in FIGS. 3A to 3C but may be the printing element substrate 15 shown in FIGS. 6A to 6C. FIG. 6A is a diagram corresponding to FIG. 3A. FIG. 6B is a cross-sectional view taken along line VIB-VIB in FIG. 6A. FIG. 6C is a cross-sectional view taken along line VIC-VIC in FIG. 6A. The printing element substrate 15 in FIGS. 6A to 6C differs from the printing element substrate 15 shown in FIGS. 3A to 3C in that the contact portions 19*b* of the partition 19, which do not communicate between the liquid supply ports in the lateral direction are formed at the center and the ends of the partition 19 when viewed from a position facing the main surface 20 of the substrate 1. Here, the center of the partition 19 refers to an area enclosed by a circle with a radius of d/5 (d is the entire length of the partition 19 in the longitudinal direction), with the center of gravity of the partition 19 in the longitudinal direction (Y-direction) as its center. The ends of the partition 19 refer to areas from the opposite ends of the partition 19 in the longitudinal direction (Y-direction) to d/5 (d is the entire length of the partition 19 in the longitudinal direction).

In the viewpoint of increasing the strength of the partition 19, the contact portion 19*b* may be formed at the center of the partition 19 in the longitudinal direction. Forming the contact portion 19*b* not only at the center but also at the ends of the partition 19 in the longitudinal direction further enhances the strength of the partition 19. In other words, also in the printing element substrate 15 shown in FIGS. 6A to 6*c*, this allows the printing element substrate 15 to have sufficient rigidity while communicating between the adjacent liquid supply ports 7 in the lateral direction by forming the non-contact portions 19*a* at the partition 19. Providing the contact portion 19*a* at least at the center of the partition 19 provides sufficient strength of the partition 19, reducing the deformation of the printing element substrate 15.

Second Embodiment

Figure 7A:
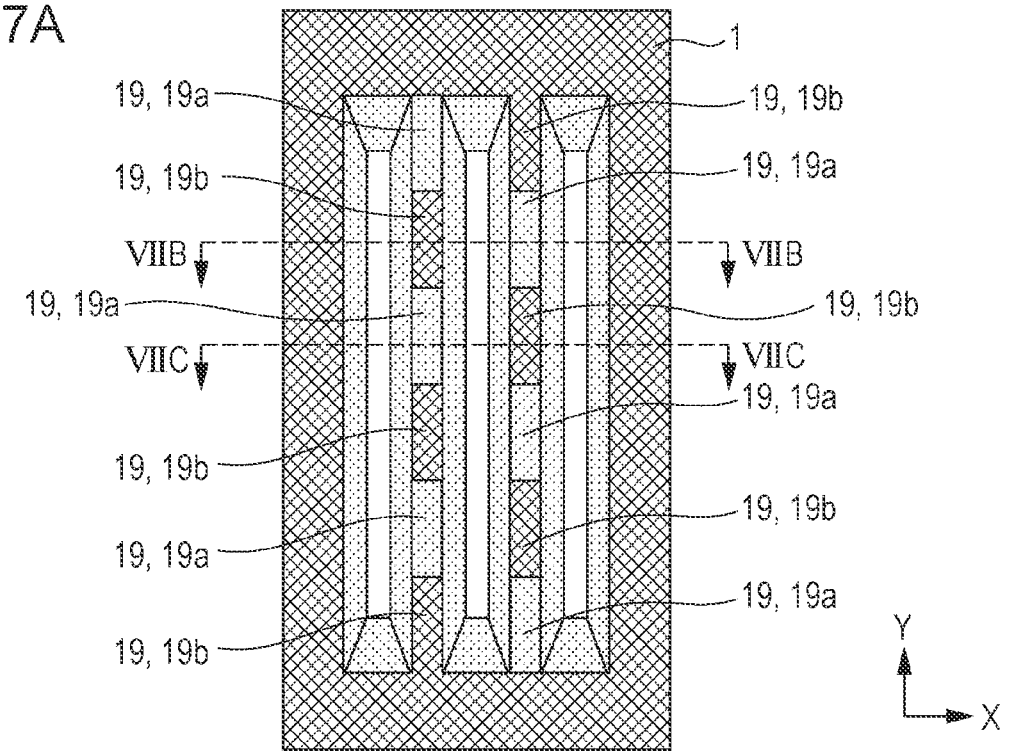
FIGS. 7A to 7C are schematic diagrams of a printing element substrate according to a second embodiment of the present disclosure.
Figure 7B:
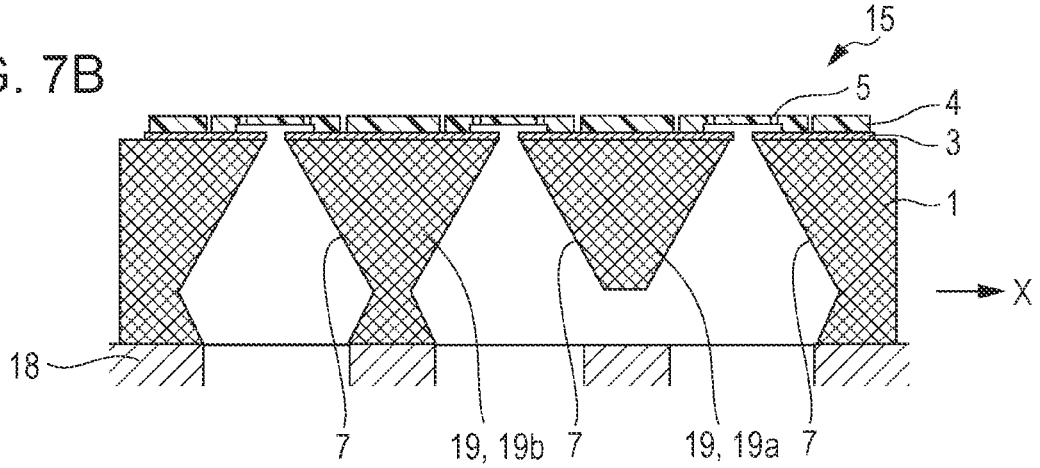
Figure 7C:
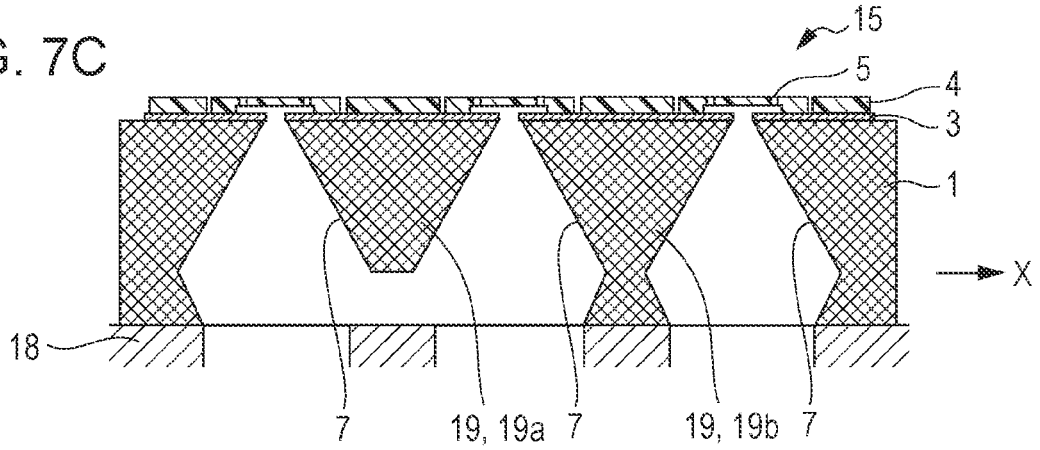
Figure 8A:
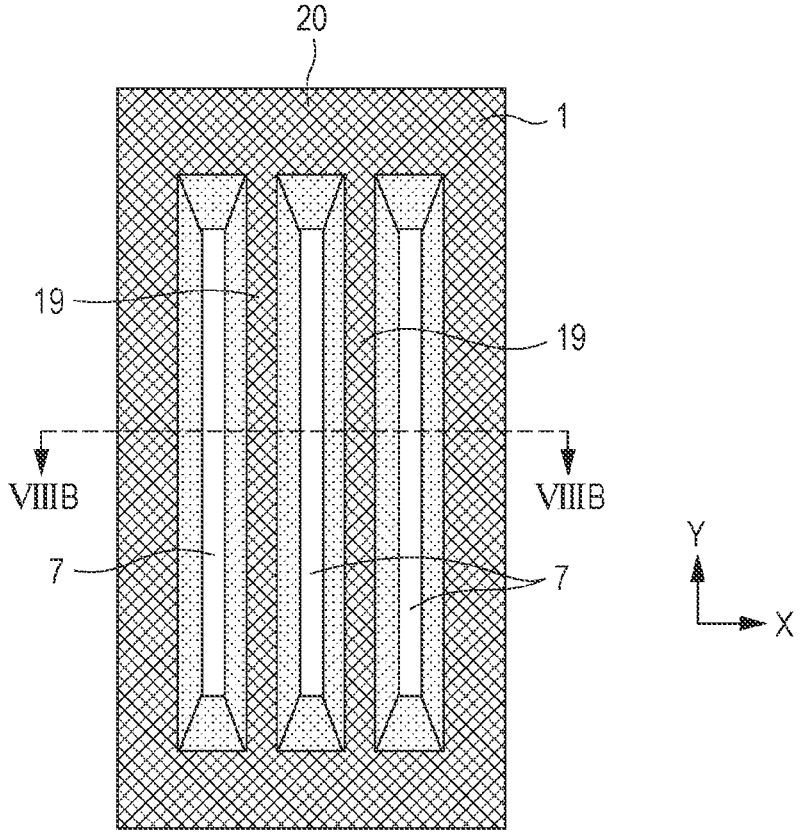
FIGS. 8A and 8B are schematic diagrams of a printing element substrate of related art.
Figure 8B:
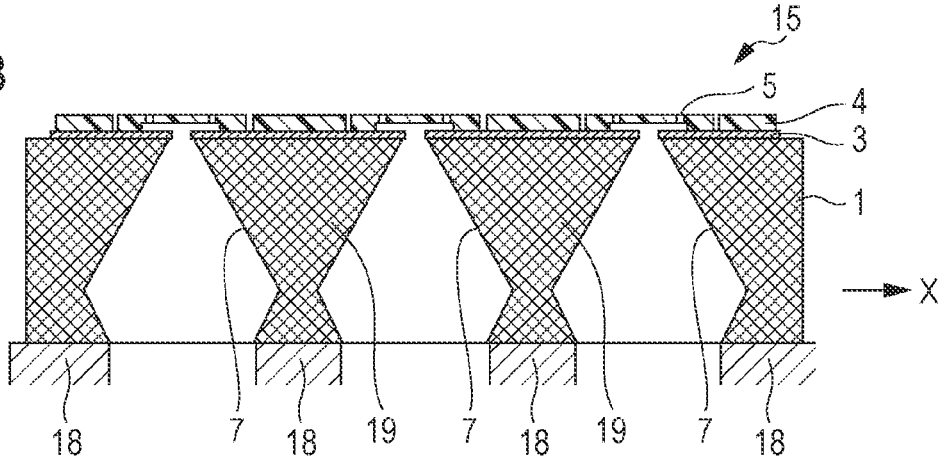
Figure 9A:
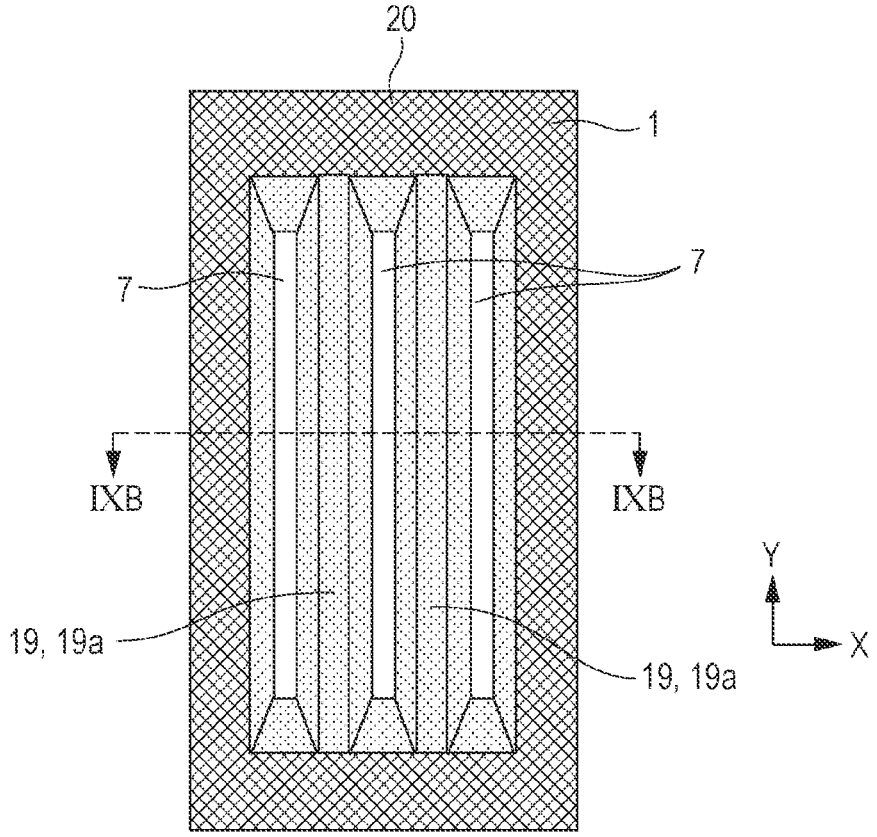
FIGS. 9A and 9B are schematic diagrams of a printing element substrate of a comparative example.
Figure 9B:
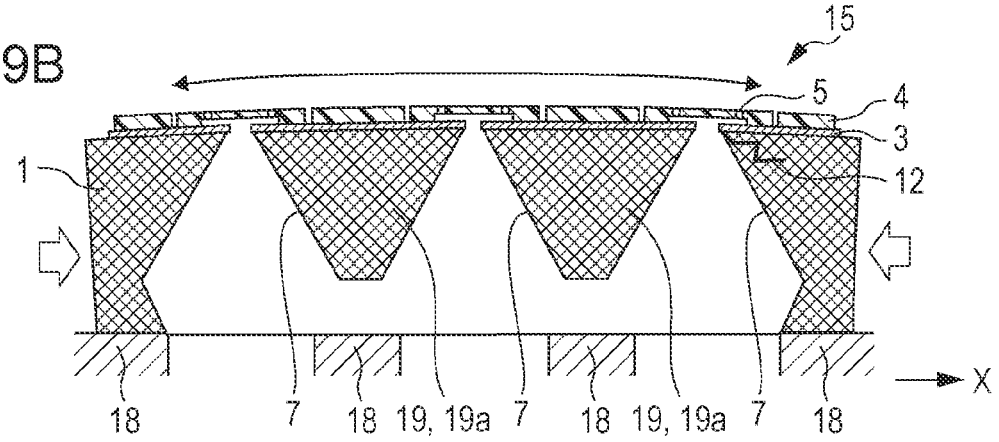

A second embodiment will be described with reference to FIGS. 7A to 7C. The same components as those of the first embodiment are given the same reference signs, and descriptions thereof will be omitted. FIGS. 7A to 7C illustrate a printing element substrate 15 according to this embodiment. FIG. 7A is a plan view of the substrate 1 viewed from the back. FIG. 7B is a cross-sectional view taken along line VIIB-VIIB in FIG. 7A. FIG. 7C is a cross-sectional view taken along line VIIC-VIIC in FIG. 7A.

As shown in FIG. 7A, this embodiment differs from the first embodiment in that the non-contact portions 19*a* that communicate between adjacent liquid supply ports 7 and the contact portions 19*b* that do not communicate therebetween are arranged in a staggered pattern. The staggered arrangement of the non-contact portions 19*a* and the contact portions 19*b* provides uniform rigidity of the printing element substrate 15 regardless of the location. This eliminates locally low rigid portions, thereby preventing deformation of the printing element substrate 15 even if a force from any direction is applied to the printing element substrate 15.

The present disclosure provides a liquid ejection head with sufficient strength of the substrate while preventing biased consumption of liquid among liquid supply ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-186561 filed Nov. 9, 2020, which is hereby incorporated by reference herein in its entirety.

What is claimed is:

1. A liquid ejection head comprising:

an ejection-port formed member including ejection ports that eject liquid;

a substrate including a plurality of liquid supply ports for supplying liquid to the ejection ports of the ejection-port formed member and a partition between the plurality of liquid supply ports; and a supporting member that supports the substrate, wherein the liquid supply ports extend along a longitudinal direction of the substrate when viewed from a position facing a main surface of the substrate, wherein the plurality of liquid supply ports are arrayed along a lateral direction of the substrate when viewed from the position facing the main surface of the substrate, wherein the partition includes a non-contact portion that is not in contact with the supporting member and a contact portion that is in contact with the supporting member, wherein, of the plurality of liquid supply ports, adjacent liquid supply ports communicate with each other in the lateral direction through a gap between the non-contact portion and the supporting member when viewed from the position facing the main surface of the substrate, and liquid flows through the gap, and wherein a plurality of contact portions, each of which is the contact portion, are arranged in a staggered pattern when viewed from the position facing the main surface of the substrate.

2. The liquid ejection head according to claim 1, wherein a plurality of the non-contact portions are arranged in the lateral direction when viewed from the position facing the main surface of the substrate.

3. The liquid ejection head according to claim 1, wherein the non-contact portion and the contact portion are arranged in the lateral direction when viewed from the position facing the main surface of the substrate.

4. The liquid ejection head according to claim 1, wherein the contact portion is provided at a center of the partition.

5. The liquid ejection head according to claim 4, wherein the contact portion is provided at an end of the partition.

6. The liquid ejection head according to claim 1, wherein the substrate comprises a silicon substrate.

7. A liquid ejection head comprising:

an ejection-port formed member including ejection ports that eject liquid;

a substrate including a plurality of liquid supply ports for supplying liquid to the ejection ports of the ejection-port formed member and a partition between the plurality of liquid supply ports; and a supporting member that supports the substrate, wherein the liquid supply ports extend along a longitudinal direction of the substrate when viewed from a position facing a main surface of the substrate, wherein the plurality of liquid supply ports are arrayed along a lateral direction of the substrate when viewed from the position facing the main surface of the substrate, wherein the partition includes a non-contact portion that is not in contact with the supporting member and a contact portion that is in contact with the supporting member, wherein, of the plurality of liquid supply ports, adjacent liquid supply ports communicate with each other in the lateral direction through a gap between the non-contact portion and the supporting member when viewed from the position facing the main surface of the substrate, and liquid flows through the gap, and wherein the contact portion is bonded to the supporting member with an adhesive.

* * * * *